United States Patent [19]

Beard, III

[11] 4,193,159

[45] Mar. 18, 1980

[54] MOBILE CLEANING APPARATUS FOR REMOVING DEBRIS FROM THE SURFACE OF PARKING LOTS AND THE LIKE

[76] Inventor: Benjamin F. Beard, III, P.O. Box 22106, Charlotte, N.C. 28222

[21] Appl. No.: 37,480

[22] Filed: May 9, 1979

Related U.S. Application Data

[63] Continuation-in-part of Ser. No. 871,034, Jan. 20, 1978, abandoned.

[51] Int. Cl.[2] ..... E01H 1/08

[52] U.S. Cl. ..... 15/340; 15/346; 15/352; 298/30

[58] Field of Search ..... 15/340, 345, 346, 352; 298/11, 24, 27, 30; 414/340, 345, 346, 347

[56] References Cited

U.S. PATENT DOCUMENTS

| | | | |
|---|---|---|---|
| 1,181,279 | 5/1916 | Williams | 15/340 X |
| 1,704,043 | 3/1929 | Green | 15/346 |
| 3,105,991 | 10/1963 | Oberg | 15/340 X |
| 3,406,424 | 10/1968 | Rush | 15/340 |
| 3,662,427 | 5/1972 | Hanna | 15/346 |
| 3,744,653 | 7/1973 | Jensen | 15/340 X |

*Primary Examiner*—Christopher K. Moore
*Attorney, Agent, or Firm*—Adams & Jenkins

[57] ABSTRACT

A mobile cleaning apparatus for removing dirt and debris from the surface of parking lots and the like characterized by the ability to quickly and efficiently remove debris from the surface to be cleaned and dump the collected debris into a remote upstanding trash bin. The mobile cleaning apparatus includes a mobile vehicle chassis and a pickup head for gathering the debris comprising a pair of forwardly swept, diverging arms including an air pressure port adjacent each opposing free end thereof and a suction port at the juncture of the arms so that dirt and debris dislodged by the air pressure ports tends to move toward the rearwardly positioned suction port. The mobile cleaning apparatus further includes a collection hopper which is movably mounted on the vehicle chassis having a positively actuated door in the bottom thereof and means for raising the collection hopper to a predetermined rearwardly raised position so that the door may be opened and collected debris dumped into a trash bin. A pneumatic pressure duct extends from each pressure port of the pickup head to the collection hopper and a pneumatic vacuum duct extends from the vacuum port of the pickup head to the collection hopper. An air blower is positioned in the collection hopper and communicates with the upstream end of the pneumatic pressure duct and the downstream end of the pneumatic vacuum duct for creating a partially regenerated air current from the collection hopper to the pickup head and back to the collection hopper.

20 Claims, 12 Drawing Figures

FIG. 9
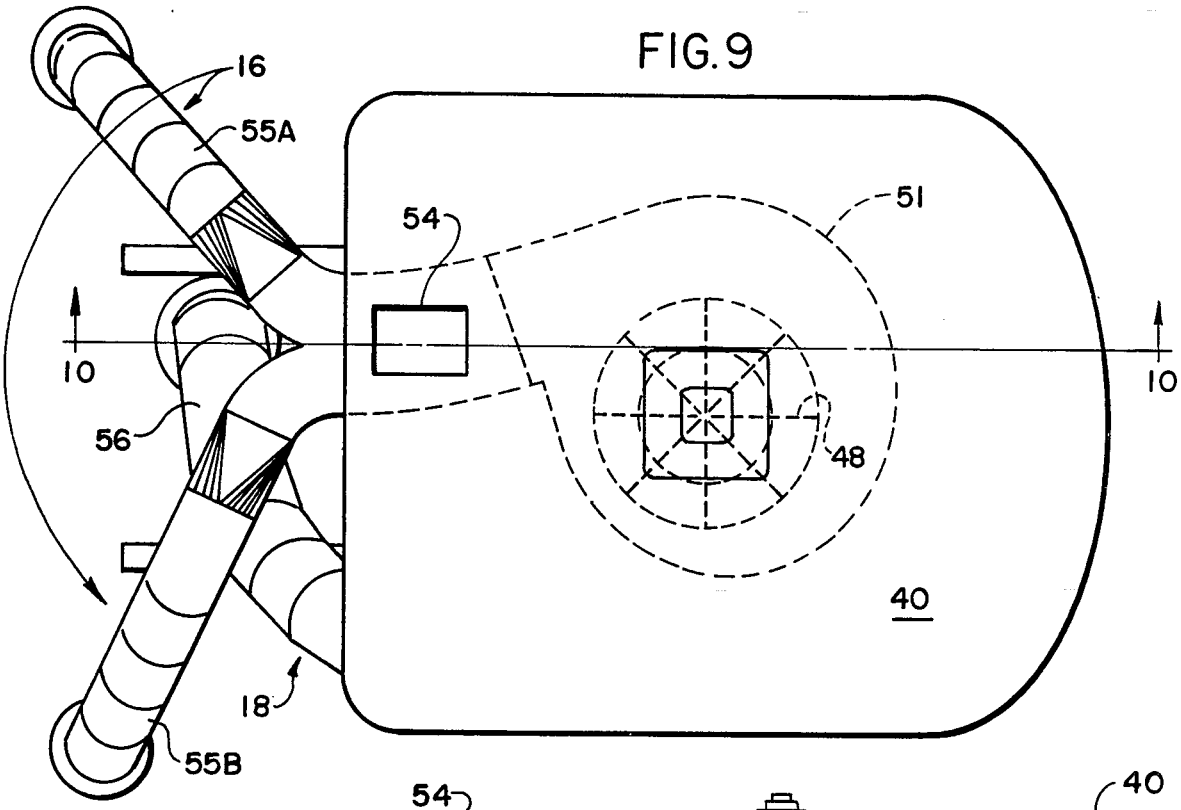
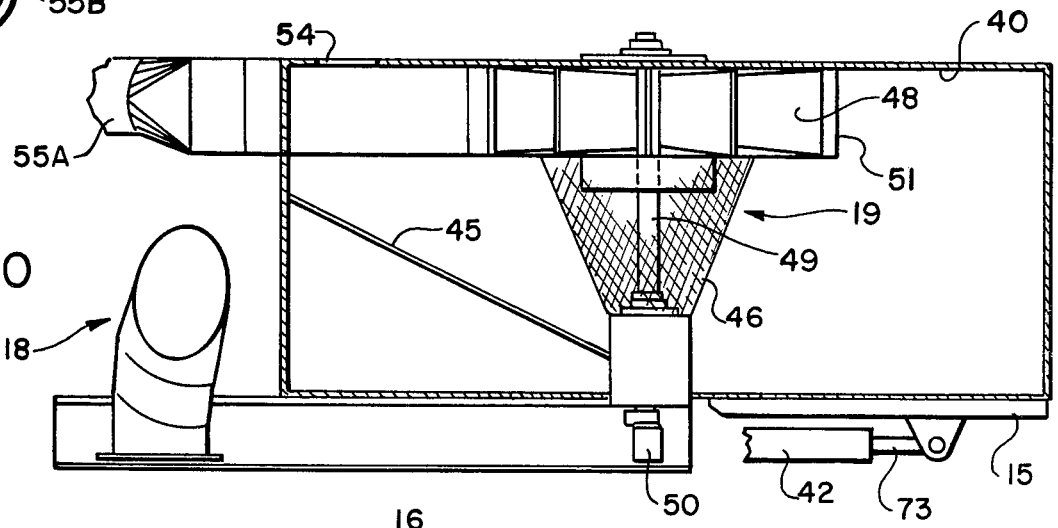
FIG. 10
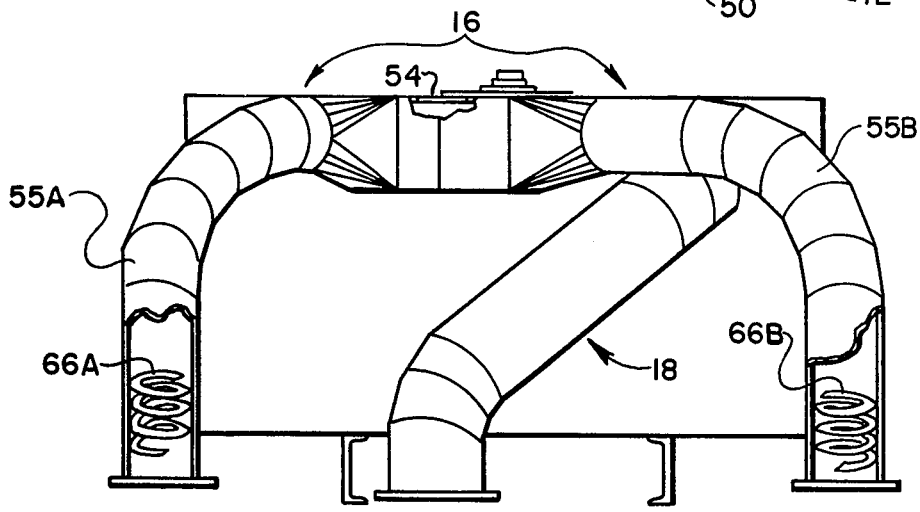
FIG. 11

MOBILE CLEANING APPARATUS FOR REMOVING DEBRIS FROM THE SURFACE OF PARKING LOTS AND THE LIKE

RELATED APPLICATIONS

This is a continuation-in-part of application Ser. No. 871,034, filed Jan. 20, 1978, and now abandoned, entitled SWEEPER.

BACKGROUND OF THE INVENTION

The present invention relates generally to a mobile cleaning apparatus having enhanced pickup efficiency and dumping or disposal capabilities relative to other known machines of this type.

In view of the recent pnenomenon of huge shopping centers and malls having a contiguous paved parking area for customer convenience comprising many acres of land, it has become necessary to utilize mechanical means to clean the dirt and debris from the vast stretches of paved acreage. Yet, it is believed that previously known mobile cleaning apparatus have all suffered from various inadequacies relating to their speed and efficiency. These inadequacies inherent in previously known cleaning apparatus when viewed in light of the great capital investment typically required to construct such a machine, have created a need for a mobile cleaning apparatus which can be efficiently operated at high surface speeds and which possesses the capability to quickly and easily dump collected debris into an assortment of standardized, free standing trash bins such as are typically found at modern shopping malls and the like.

Mobile cleaning apparatus have previously been known utilizing either a vacuum, or a vacuum in combination with positive air pressure to clean a surface area. Typical of this type of apparatus is U.S. Pat. No. 1,704,043 issued to Green which discloses a suction street cleaner. This cleaner utilizes both positive air pressure and vacuum currents supplied to a pickup head for cleaning a street surface, but the device apparently does not possess the capability to dump the collected contents into a remote free standing trash bin or garbage collector typically found at the site of large parking lots. The pickup head, due to its diamond-shaped configuration having the pressure duct located at its leading point, would tend to push light trash and dirt away from the head in the fashion of a snow shovel as opposed to the present invention which is designed to trap debris within the pickup head so as to facilitate vacuum removal. U.S. Pat. No. 3,744,653 to Jensen discloses a lift dump vacuum apparatus which depends solely on a pneumatic vacuum head to remove dirt and debris from a surface area. The apparatus is therefore believed to be inherently less efficient in cleaning a parking lot than the apparatus of the present invention. Because dirt and debris communicate directly with the fan blades, there is considerable wear and deterioration of the air blower. Also, the dumping means disclosed by the Jensen patent comprises a hopper which is upwardly and rearwardly raised by hydraulic rams. The hopper is hydraulically tilted downwardly and its back door opened to allow the contents to slide downwardly under the influence of gravity. This apparatus is believed to be inherently less efficient in dumping accumulated debris, particularly mud and the like, than the present invention which utilizes a hydraulically actuated bottom door in the collection hopper means. Furthermore, the apparatus disclosed in Jensen requires a support arm and pad adjacent the rear end of the vehicle chassis for stabilizing the apparatus when the collection hopper is raised—a structure which is unnecessary on the sweeper according to the present invention.

U.S. Pat. No. 3,662,427 to Hanna discloses a vacuum-pressure apparatus for sweeping exterior areas, comprised primarily of a conventional open bed truck having a pressure and vacuum system mounted on its bed. The patent discloses a fixed collector compartment which cannot be raised for emptying into a trash bin, and a transversely mounted, rectilinear pickup head having a pressure duct at one end and a vacuum duct at the other. This pickup head configuration attempts to force dirt and debris dislodged by the air pressure supplied at one end of the pickup head in a direction perpendicular to the axis of travel of the vehicle to the suction outlet at the opposing end of the pickup head. Hence, the sweeper must move at a relatively slow speed.

An air sweeper apparatus is known to be manufactured under the trade name TYMCO (Model 210) having a hopper which pivots upwardly for dumping in a similar fashion to a dump truck bed and utilizing a transversely mounted pickup head with a laterally spaced-apart pressure port and vacuum port for collecting debris. The machine includes a fan positioned outside the hopper and is believed to be substantially less efficient in use than the apparatus of the present invention.

Other street and parking lot cleaning equipment of interest are disclosed in U.S. Pat. No. 3,406,424 to Rush, U.S. Pat. No. 3,105,991 to Oberg and U.S. Pat. No. 1,181,279 to Williams. These patents disclose cleaning apparatus which utilize air pressure and suction in combination with a cleaning brush, and vacuum suction sweepers in combination with cleaning brushes. These devices are believed to be inherently less efficient and practical than the apparatus of the present invention for the reasons outlined above, among others.

SUMMARY OF THE INVENTION

Accordingly, it is the object of this invention to provide a mobile cleaning apparatus for pneumatically removing dirt and debris from the surface of parking lots and the like in a more expeditious and efficient manner than has been possible heretofore.

It is a further object of the present invention to provide a mobile cleaning apparatus for pneumatically removing dirt and debris from the surface of parking lots and the like which is adapted to permit the operator to drive the cleaning apparatus at a high rate of speed while still providing superior cleaning performance.

It is another object of the present invention to provide a mobile cleaning apparatus for pneumatically removing dirt and debris from the surface of parking lots and the like which includes a movably mounted collection hopper which may be raised upwardly and rearwardly when full to allow the contents to be dumped into a free standing trash bin.

It is still another object of the present invention to provide a mobile cleaning apparatus for pneumatically removing dirt and debris from the surface of parking lots and the like which provides means for vertically raising and lowering the pickup head to allow adjustment for the particular type of debris being removed. The pickup head can also be raised to an inoperative position when desired.

These and other objects and advantages of the present invention are achieved in the embodiment illustrated herein by the provision of a mobile cleaning apparatus which comprises a mobile vehicle chassis, a pickup head for collecting debris and carried by the chassis at a predetermined spaced relationship from the surface to be cleaned and having an air pressure port and a vacuum port therein, and collection hopper means movably mounted on the vehicle chassis and having a positively actuated door in its bottom. Pneumatic pressure conduit means are provided extending from the air pressure port of the pickup head to the collection hopper means. Pneumatic vacuum conduit means are provided extending from the vacuum port of the pickup head to the collection hopper means.

An air pump means is positioned in the collection hopper means and communicates with the pressure conduit means and the vacuum conduit means. The air pump means creates a partially regenerated air current from the collection hopper means to the pickup head for entraining debris from the surface beneath the pickup head into an air current, and a suction current from the pickup head to the collection hopper means for transporting the entrained debris to the collection hopper means for collection.

A means for raising the collection hopper means to a predetermined rearwardly raised position is provided by the present invention so that the bottom door of the collection hopper means may be opened and the collected debris dumped into a typical freestanding trash bin. The means for raising the collection hopper means comprises a plurality of rigid support legs of substantially equal length, each pivotally connected at one end to the vehicle chassis and at the other end to the collection hopper means, and a hydraulic ram lift means carried by the vehicle chassis and operatively connected to the collection hopper means.

BRIEF DESCRIPTION OF THE DRAWINGS

Some of the objects of this invention have been set forth above, other objects and advantages will appear as the description of the invention proceeds, when taken in conjunction with the following drawings in which:

FIG. 9 is a top plan view of the collection hopper means and the pneumatic pressure and vacuum conduit means extending therefrom;

FIG. 10 is a cross-sectional view of the collection hopper means taken substantially along the line 10—10 of FIG. 9 and showing the inverted conical screen and radial fan positioned therewithin; and FIG. 11 is a front elevational view of the collection hopper means and pneumatic pressure and vacuum conduit means communicating therewith.

DETAILED DESCRIPTION OF THE PREFERRED EMBODIMENT

Figure 1:
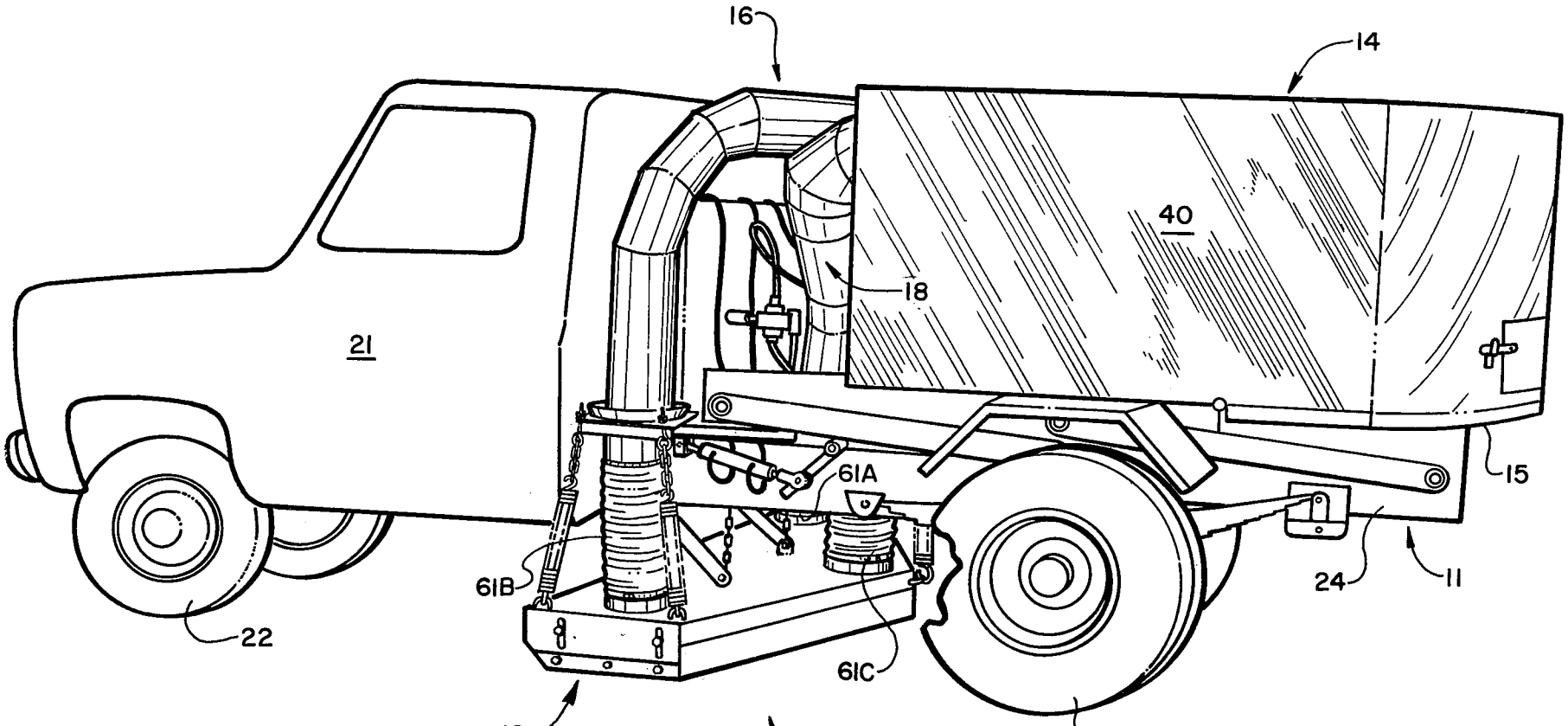
FIG. 1 is a perspective view of the mobile cleaning apparatus with the collection hopper means thereof in its lowered position.

Referring now to the drawings, a mobile cleaning apparatus for pneumatically removing dirt and debris from the surface of parking lots and the like according to the present invention is shown in FIG. 1 and generally indicated at 10.

Figure 6:
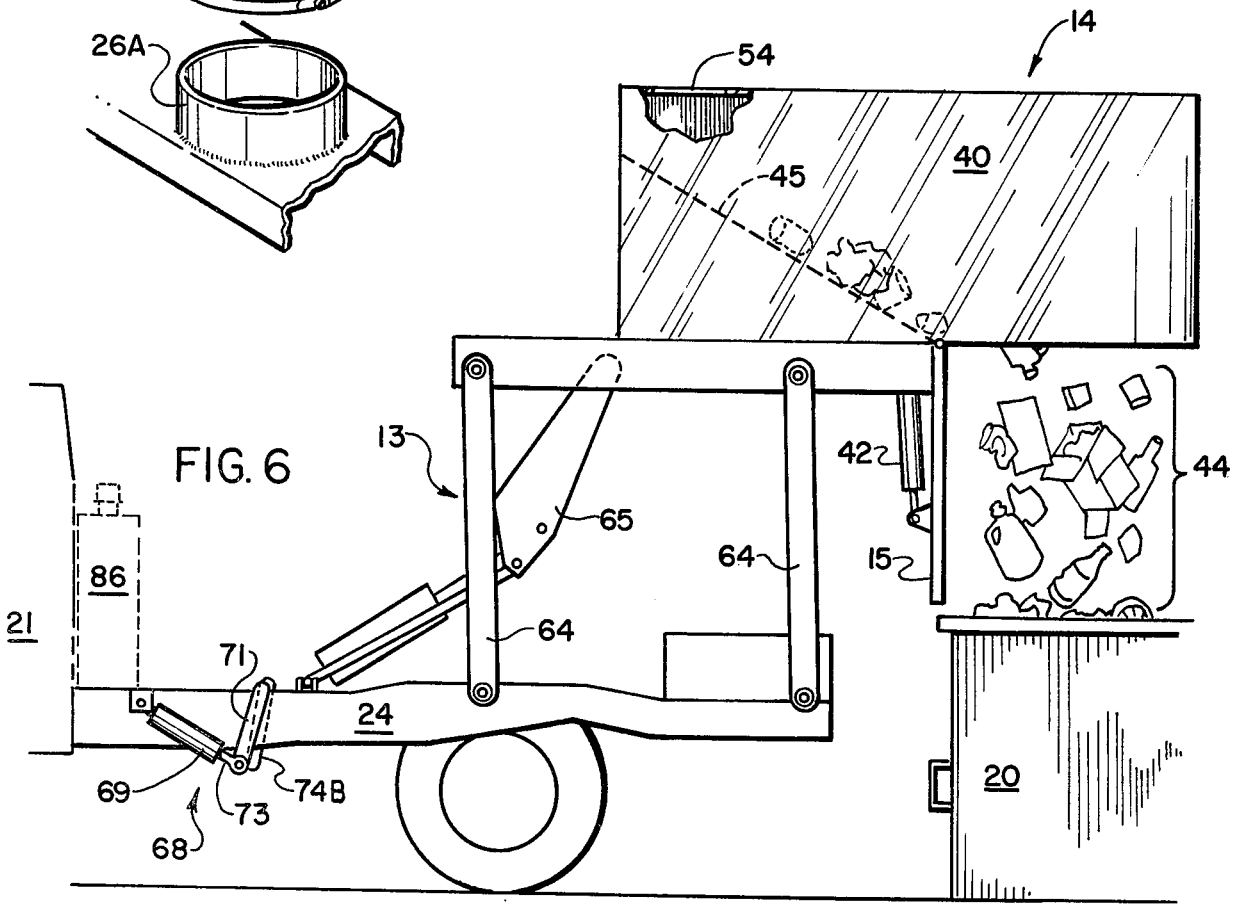
FIG. 6 is a side elevational view of the mobile cleaning apparatus with the collection hopper means lifted to its rearwardly raised position and having the bottom door thereof opened so as to allow the collected debris to fall into a trash bin.

The mobile cleaning apparatus 10 comprises a mobile vehicle chassis 11 which may suitably be any type of truck chassis with the cab located at the front portion. A pickup head 12 for collecting dirt and debris is carried by the chassis 11 at a predetermined spaced relationship from the surface to be cleaned. Collection hopper means 14 is raisably mounted on the vehicle chassis 11 and has a positively actuated door 15 in the bottom. Pneumatic pressure conduit means 16 are provided and extend from the collection hopper means 14 to the pickup head 12. A pneumatic vacuum conduit means 18 is also provided to extend from the pickup head 12 to the collection hopper means 14. An air pump means 19, as best seen in FIGS. 9 and 10, is positioned in the collection hopper means 14 and communicates with the pressure conduit means 16 and the vacuum conduit means 18 for creating a partially regenerated air current from the collection hopper means 14 to the pickup head 12 for entraining debris from the surface beneath the pickup head 12 into the air current formed therein and for creating a suction current from the pickup head 12 to the collection hopper means 14 for transporting the entrained debris and dirt to the collection hopper means 14 for accumulation and eventual disposal. A means for raising the collection hopper means to a predetermined rearwardly raised position 13, as best shown in FIGS. 2 and 6 is provided and allows the bottom door 15 to be opened and the debris collected within the collection hopper means 14 to be dumped into a trash bin 20.

Referring now more specifically to the drawings, in FIG. 1 it can be seen that mobile vehicle chassis 11 is shown to include a conventional cab 21, wheels 22 and frame 24.

Figures 2, 3, 4:
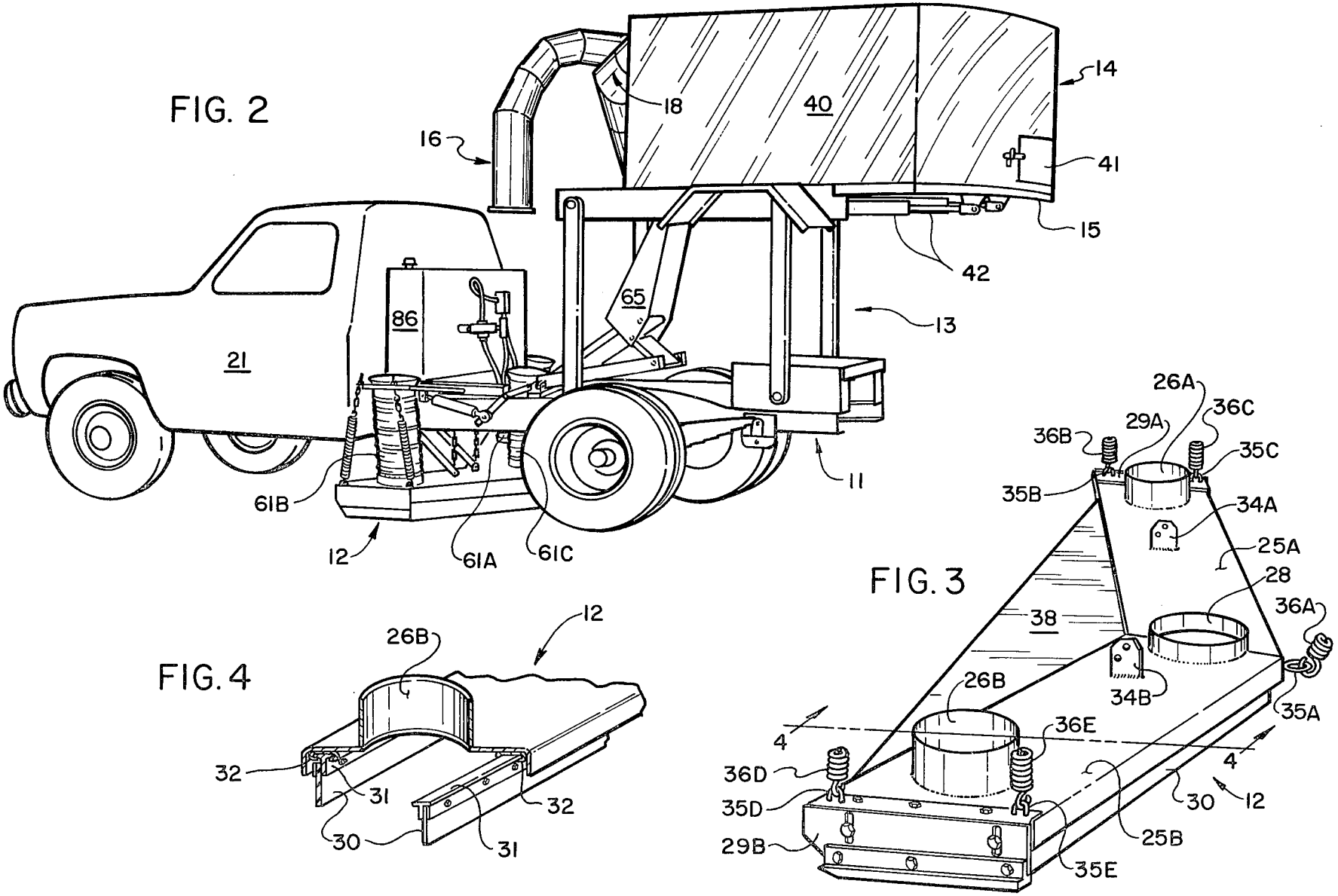
FIG. 2 is a perspective view of the mobile cleaning apparatus with the collection hopper means lifted to its rearwardly raised position.
FIG. 3 is a perspective view of the pickup head of the mobile cleaning apparatus.
FIG. 4 is a fragmentary sectioned perspective view of the pickup head taken substantially along the line 4—4 of FIG. 3 and showing an air pressure port and the downwardly depending flexible members removably secured adjacent the leading and trailing edge of the pickup head.
Figure 3A:
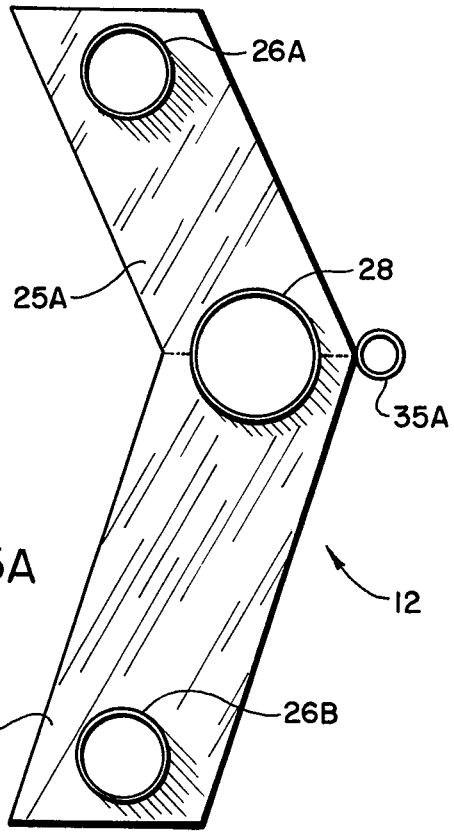
FIG. 3A is a top plan view of the pickup head of the mobile cleaning apparatus.

The pickup head 12, as best seen in FIGS. 3 and 3A, comprises outwardly extending and opposing arms **25*a* and 25*b* which are swept forwardly in the direction of the cab 21. The pickup head 12 includes air pressure ports 26*a*, 26*b* at the end of opposing arms 25*a*, 25*b*, respectively, and communicating with the interior of the pickup head 12. A vacuum port 28 is located in the pickup head 12 at the juncture of the opposing arms 25*a***, 25*b*. As best seen in FIGS. 3 and 4, the pickup head 12 includes a skid plate 29*a*, 29*b* located on its opposing ends, suitably formed of steel, for protecting the pickup head 12 when it comes into occasional sliding contact with the surface to be cleaned. Downwardly extending flexible members 30, suitably formed of a durable rubber compound, are secured to the leading and trailing edges of the pickup head 12 for substantially enclosing and enhancing the air pressure currents and suction current created for stirring up and removing dirt and debris from the surface being cleaned. The flexible members 30 are removably secured to the pickup head 12 by brackets 31 which are slidably received within tracks 32 secured to the pickup head 12 adjacent its leading and trailing edges. Two attachment tabs 34*a*, 34*b* are fixedly secured to the top surface of the pickup head 12 and serve as means by which the pickup head 12 is adjustably secured to the vehicle chassis 11. Metal eyelets 35*a, b, c, d, e* are utilized as additional securement points by means of stabilizing springs 36*a, b, c, d, e*, respectively, being attached thereto at one end, the springs being connected to the chassis 11 at the other end thereof.

A triangular stabilizing plate 38 is secured to the leading edges of the pickup head 12 to provide integrity and rigidity to the pickup head and prevent debris from blowing over the pickup head when the mobile apparatus is traveling over the surface at relatively high speeds.

Figure 5:
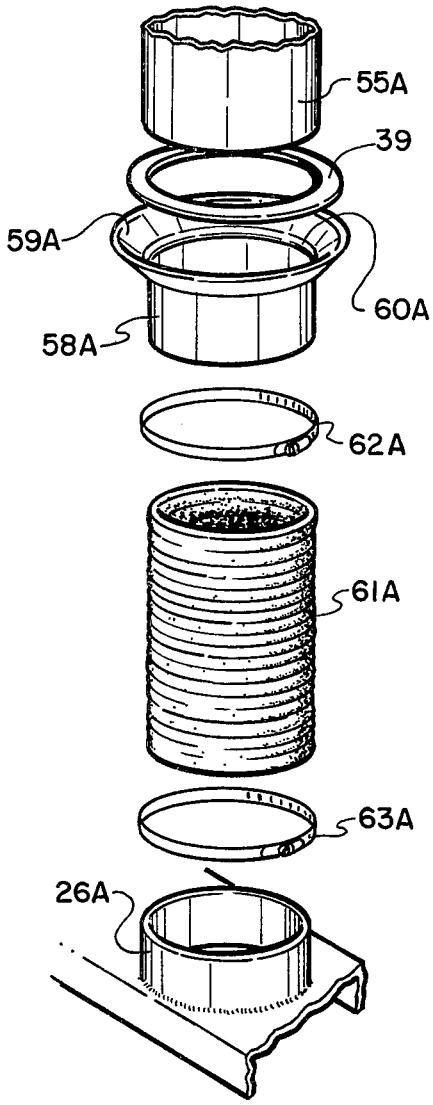
FIG. 5 is an exploded perspective view of the right-hand pressure port of the pickup head (facing in the forwardly swept direction of the pickup head) and the elements used to connect the port to one end of the air pressure duct extending from the collector hopper means.

At this point, it should be noted that the pickup head 12 is not perfectly symmetrical and that the vacuum port 28 is not positioned in its exact center (FIG. 3A). Arm 25*a* of the pickup head 12 is somewhat shorter than the opposing arm 25*b*. This can be best understood by observing FIG. 9. Pneumatic vacuum conduit means 18 extends downwardly from the collection hopper means 14 to communicate with the vacuum port 28. Vacuum port 28 is offset from the longitudinal axis of the mobile vehicle chassis 11 in order to circumvent the drive shaft which it would otherwise intersect. Since the vacuum port 28 is at the juncture of arms 25*a*, 25*b*, it therefore follows that arm 25*a*, in fact, must be shorter than opposing arm 25*b*. However, the invention contemplates that there be an equalized air pressure in the pickup head 12 at the juncture of arms 25*a*, 25*b* to pick up and dislodge dirt and debris and to uniformly direct the same inwardly and rearwardly toward the vacuum port 28 for removal to the collection hopper means 14. The balanced air pressure from the air pressure ports 26*a*, 26*b* is achieved, as shown in FIG. 5, by placing a reducer baffle 39 into the pneumatic pressure conduit means 16 extending from the collection hopper means 14 to the air pressure port 26*a* of the pickup head 12. The reducer baffle 39 reduces the inside diameter of the portion of the pneumatic pressure conduit means 16 leading to the pickup head 12 so as to assure an equalized air pressure from air pressure port 26*a*, 26*b* toward the vacuum port 28.

As best shown in FIGS. 2, 9 and 10, the collection hopper means 14 is movably mounted on the vehicle chassis 11 and comprises a collection hopper 40 with the positively actuated door 15 in its bottom. The door 15 is pivoted so as to be capable of opening downwardly when actuated by a pair of laterally spaced-apart hydraulic rams 42 which are each positioned beneath the collection hopper 40 and pivotally secured thereto at one end and secured to the bottom door 15 at the other end. In this manner, when the hydraulic rams 42 are actuated, the normally extended piston arms thereof are withdrawn into the cylinders of the hydraulic rams 42 and the bottom door 15 caused to pivot downwardly to allow the accumulated dirt and debris 44 (FIG. 6) to fall downwardly into the trash bin 20.

As is clearly shown in FIGS. 6, 9 and 10, the collection hopper 40 has a downwardly sloping plate 45 positioned in the front end thereof and extending generally downwardly toward the bottom door 41 to facilitate accumulation of dirt and debris in the rearward portion of the collector hopper 40 directly on the top surface of the bottom door 15. Therefore, sloping plate 45 facilitates both the collection of dirt and debris over the bottom door 15 and assures that when the bottom door 15 is caused to open by actuation of the pair of hydraulic rams 42, all of the remaining dirt and debris in the collection hopper 40 will slide rearwardly toward the open door 15 and into the trash bin 20. An inspection door 41 is located in the back wall of collection hopper 40 allowing for inspecting the interior of the hopper and throwing large articles directly into the hopper.

Air pump means 19 is positioned substantially in the center portion of collection hopper 40 and operatively connects to the pneumatic pressure conduit means 16 and the pneumatic vacuum conduit means 18. The air pump means 19 comprises the conical filter screen 46 and a radial fan 48 positioned therewithin. The radial fan 48 is fixedly secured to a shaft 49 which extends downwardly through the vertical axis of the conical filter screen 46 to a suitable hydraulic motor 50, such as a piston-type hydraulic motor sold under the trade name VICKERS. The VICKERS hydraulic motor has been found to perform well in the present invention with a capability of 2,700 revolutions per minute when driving a 12 inch radius fan 48 having blades approximately 8 inches wide at their tips. The conical filter screen 46 is 36 inches in diameter at the top and four inches in diameter at the bottom and may be suitably constructed in two half sections of $\frac{3}{4}$ inch expanded metal and joined together by fasteners. The shaft 49 is journaled in bearing mounts at its top and bottom ends. The placement of the motor 50 at the bottom of the collector hopper 40 has been found to lend itself to easy maintenance and service. An air plenum 51 is provided to encompass the radial fan 48.

Pneumatic pressure conduit means 16 extends inwardly into the collector hopper 40 and is connected to and communicates with the air plenum 51 surrounding the radial fan 48. Also, pneumatic vacuum conduit means 18 is connected to the upper portion of the collector hopper 40 and communicates with its interior above the plate 45. When hydraulic motor 50 is actuated and the radial fan 48 is rotating, an air current is generated in the air plenum 51 and directed into the upper end of the pneumatic pressure conduit means 16. The radial fan 48 is concurrently creating a suction or vacuum current beneath the radial fan 48 in the substantially enclosed collector hopper 40. This vacuum results in a pneumatic suction current being drawn upwardly through the pneumatic vacuum conduit means 18 and into the collector hopper 40, through the conical filter screen 46 and to the air plenum 51 in which the radial fan 48 is located. The air stream is partially regenerated since some of the air pulled through pneumatic vacuum conduit means 18 is recycled out through pneumatic pressure conduit means 16 with some air leakage through a port 54 (FIG. 9) positioned in the uppermost end of the pneumatic pressure conduit means 16. The purpose of the port 54, which has been found to function well when essentially of a 7 inch by 6½ inch rectangular configuration extending in the longitudinal direction of vehicle chassis 11, is to keep the air flow into the pneumatic pressure conduit means 16 in equilibrium. This avoids pressure buildup on the fan 48 which could reduce the functioning capability of the apparatus.

The pneumatic pressure conduit means 16 can best be seen in FIGS. 9 through 11 to comprise two downwardly extending tubes, which may suitably be fashioned from 8 inch diameter steel conduit, with a right leg 55*a* being of a somewhat shorter length than a left leg 55*b*. This is due in part to the fact, as noted, that the right arm 24*a* of the pickup head 12 is shorter than the opposing arm 25*b* thereof. As has also been noted previously, in order to equalize the air pressure of the pickup head 12 at the vacuum port 28, a baffle 39 (FIG. 5) has been placed in the leg 55*a* so as to effectively reduce the diameter thereof adjacent to the pickup head 12 from 8 inches to 5 inches. This substantially balances the air pressure in the pickup head 12 at the juncture of the opposing arms 25*a*, 25*b*. This effect cannot be overemphasized since a large part of the effectiveness of the mobile cleaning apparatus is attributable to the forwardly swept configuration of the opposing arms 55*a*, 55*b* of the pickup head 12, and the manner in which this tends to push the loosened dirt and debris toward the trailing vacuum port 28 where it is removed.

The pneumatic vacuum conduit means 18 contains a single leg 56 extending downwardly from the collector bin 40 to a communicating connection with the pickup head 12. The leg 56 is of a 10 inch diameter metal tube fabricated from a suitable material such as steel. The leg 56 extends upwardly from the pickup head 12 at such a predetermined angle as to allow the debris to crawl upwardly along its bottom surface to the collection hopper 40. This allows for large items of debris to be picked up, such as beer bottles, cans and tennis shoes, which are impossible to remove with many other types of apparatus. In other words, a given suction power through the leg 56 will result in heavier debris being pickup up due to the ability of the debris to "crawl" upwardly to the collection hopper 40.

As is shown in FIG. 2, the pneumatic pressure conduit means 16 and the pneumatic vacuum conduit means 18 are constructed so that they can break away from their communication with the pickup head 12 when the collection hopper means 14 is raised to its rearwardly raised dumping position. This is achieved by the use of three sleeves 58*a*, 58*b* and 58*c*, as best seen in FIG. 5, each of which communicates with the associated air pressure port 26*a*, 26*b* and 28, respectively, of the pickup head 12 and is held in an adjustably fixed relationship thereto. The sleeves 58*a*, 58*b* and 58*c* are constructed so as to matingly receive the corresponding lower end of the legs 55*a*, 55*b* and 56, respectively, of the pneumatic pressure conduit means 16 and vacuum conduit means 18 when the collection hopper means 14 is lowered into its operative position in communication with the pickup head 12. When the collection hopper means 14 is raised to its upwardly and rearwardly disposed position, as best seen in FIGS. 2 and 6, the matingly received connection is broken and there is no communication between the pickup head and the collection hopper means 14. This feature is convenient and allows for the collection hopper 40 to be raised without the necessity for expandable or flexible conduits. It is believed that the apparatus of the present invention is more durable and significantly more practical when placed into a daily commercial usage.

Referring again to FIG. 5, it can be seen that the sleeve 58*a* has a flared collar 59*a* for guidingly receiving leg 55*a* and a shoulder 60*a* for supporting same. The short leg 55*a* of the pneumatic pressure conduit means 16 also requires that the sleeve 55*a* include the reducer baffle 39 therein for equalizing the pressure within the pickup head 12. The sleeve 58*a*, rigidly secured to the chassis frame 24 is connected to the air pressure port 26*a* by a flexible rubber hose 61*a*, having an 8 inch diameter, with metal bands 62*a* and 63*a* utilized to secure the flexible rubber hose 61*a* at one end to the sleeve 58*a* and at the other end to the air pressure port 26*a*. It is to be understood in the above description relating to FIG. 5 of the drawings that the exact same structure, without the reducer baffle 39, is utilized on the other side of the pickup head 12 to connect the air pressure port 26*b* to the leg 55*b* and similar structure with a 10 inch diameter is utilized to connect vacuum port 28 to the leg 56.

The present invention contemplates the use of a helical metal coil 66*a*, 66*b* which may suitably be about 17 inches in length, 8 inches in diameter, and 1 inch in width, in legs 55*a*, 55*b*, respectively, of the pneumatic pressure conduit means 16 for creating turbulent or "cyclone" air current which will facilitate picking up small dirt particles and dust and entraining them in the air current for removal through the air vacuum port 28 at the juncture of the opposing arms 25*a*, 25*b* of the pickup head 12. The helical coils 66*a*, 66*b* are positioned within the downwardly extending legs 55*a*, 55*b*, respectively, adjacent to their lower end as is shown in FIG. 11. It is contemplated that the helical coil 66*a* in leg 55*a* will be coiled in a clockwise direction from bottom to top and the helical coil 66*b* in leg 55*b* will be coiled in a counterclockwise direction from bottom to top. This results in opposing "cyclone" air currents within the pickup head 12 which facilitates the removal of the dirt and dust particles to the trailing air vacuum port 28 at the back portion of the pickup head 12.

The means for raising the collection hopper means 13 to a predetermined rearwardly raised position is best shown in FIGS. 2 and 6 and comprises four rigid support legs 64, each having a length of about 45 inches and pivotally connected at one end to the vehicle chassis 11 and at the other end to the collection hopper means 14. A hydraulic ram lift means 65 is carried by the vehicle chassis 11 and operatively connected to the underside of the collection hopper means 14. The hydraulic ram lift means 65 is of the general type utilized to tilt the bed of a dump truck. The hydraulic lifting means 65 in combination with the parallel rigid support legs 64 has been found to provide a very stable configuration for lifting the collection hopper 40 and securely holding it in the raised position while dumping debris without the necessity for any auxiliary stabilizing equipment.

Figure 8:
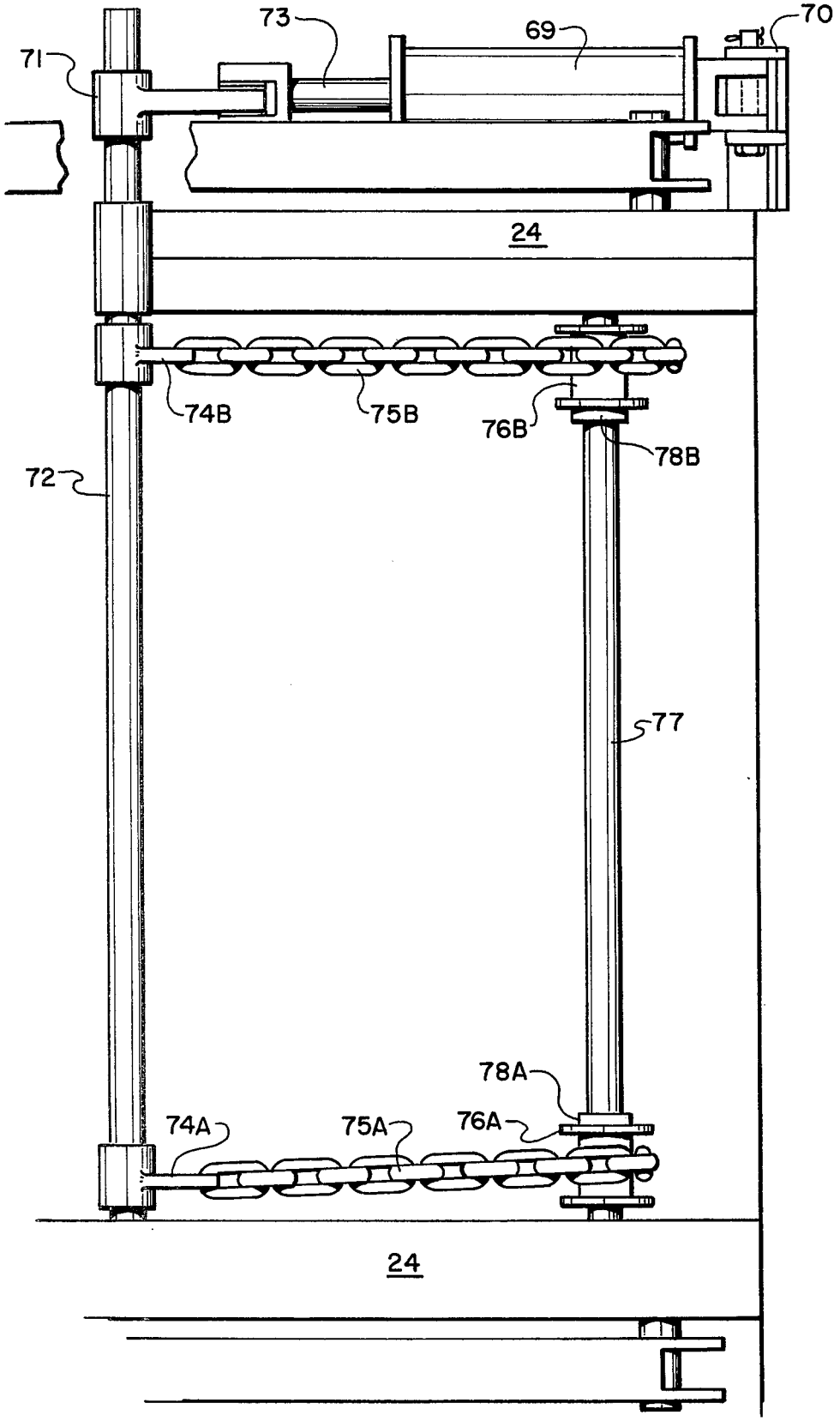
FIG. 8 is a top plan view of the hydraulically actuated bell and crank for vertically adjusting the pickup head of the present invention.

As shown in FIGS. 6 and 8, means for vertically adjusting the pickup head 12, generally designated at 68, are carried by the vehicle chassis 11 and operatively connected to the pickup head 12 for vertically adjusting it to a predetermined distance from the surface to be cleaned. The pickup head 12 may be raised to a varying distance from the surface in order to accommodate varying types of debris to be removed, or it may be lifted still further to an inoperative raised position.

The means for vertically adjusting the pickup head 68 comprises a hydraulic ram 69 which is secured to the frame 24 of the vehicle chassis 11 by a clevis mounting 70 at one end. The piston arm 73 of the hydraulic ram 69 is movably connected to the lower end of a lever arm 71 which is fixedly secured to a shaft 72 which extends transversely across the vehicle frame 24 and is rotatably mounted on the frame at each end.

A pair of lever arms 74*a*, 74*b* are also fixedly mounted to the shaft 72 in spaced apart relationship and within the frame 24 so as to extend downwardly at generally the same angle as lever arm 71. The lever arms 74*a*, 74*b* have a chain 75*a*, 75*b*, respectively, connected to the lower end thereof and extending over respective free roller guides 76*a*, 76*b*, respectively, held in a relatively constant, axial location on a shaft 77 by collars 78*a*, 78*b* which are welded to the shaft 77. The chains 75*a*, 75*b* travel over the free spinning rollers guides 76*a*, 76*b* and extend downwardly toward the surface to be cleaned so as to connect at their remote end to the tabs 34*a*, 34*b* (FIG. 3) fixedly secured to the pickup head 12. In this fashion, to raise the pickup head 12, the hydraulic ram 69 is actuated and the piston arm 73 is further extended so as to pivot the lever arms 74*a*, 74*b* rearwardly toward the back of the mobile vehicle chassis 11 causing the chains 75*a*, 75*b* to be pulled rearwardly. This results in the pickup head 12 being raised as the remote ends of the chains 75*a*, 75*b* are pulled upwardly toward the roller guides 76*a*, 76*b*. To lower the head, the above operation is performed in reverse.

Figure 7:
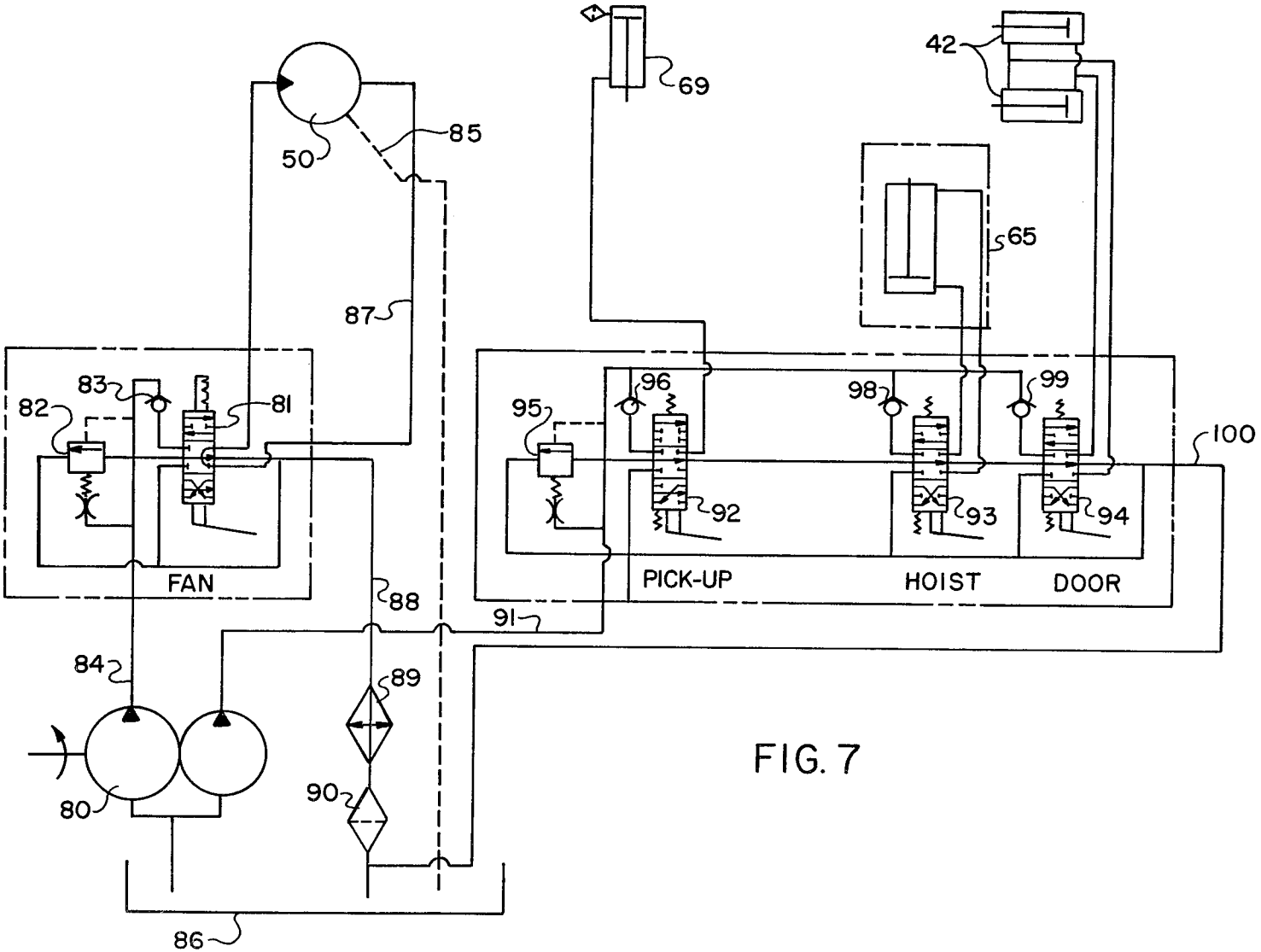
FIG. 7 is a schematic view of the hydraulic system for the mobile cleaning apparatus of the present invention.

A schematic of the hydraulic system of the invention is shown in FIG. 7. The main hydraulic pump 80, a double vane pump (VICKERS MODEL G2020) is capable of a maximum speed of 3600 revolutions per minute and a flow rate of up to 40 gallons of hydraulic fluid per minute. One vane of hydraulic pump 80 drives the fan motor 50 through manual switch 81 which includes relief valve 82 and check valve 83 in the main line 84 leading to the switch 81. A drain line 85 from the hydraulic motor 50 extends back to a reservoir 86 from which the pump 80 draws its hydraulic fluid. A return line 87 extends from the fan motor 50 back to the manual switch 81 and the manual switch 81, which may suitably be a three position, four-way valve, has a return line 88 leading therefrom and through cooler 89 and filter 90 to the reservoir 86.

The second vane of the pump 80 has a main line 91 which extends to a bank of three switches 92, 93 and 94 for operating the pickup head 12, the hydraulic lift means 65, and the pair of hydraulic rams 42, respectively. Relief valve 95 is provided in the main line to the bank of manual switches and check valves 96, 98 and 99, respectively, are associated with manual valves 92, 93 and 94. Manual switch 92 controls hydraulic ram 69, manual switch 93 controls the hydraulic ram for the hydraulic means 65 and manual switch 95 controls the pair of spaced apart hydraulic rams 42. A return line 100 is fluidly connected to each of the manual switches and extends therefrom back to the reservoir 86.

In operation, the mobile cleaning apparatus can be easily controlled from the cabin 21 in which all of the manual switches 81, 92, 93 and 94 may be located. After the vehicle is started, the motor drives the hydraulic pump 80 through a power take-off from the transmission which may be manually engaged, and provides the hydraulic flow necessary to actuate all mechanisms of the mobile cleaning apparatus. The driver drives the apparatus to the surface area which is to be cleaned where he lowers the pickup head 12 by throwing manual switch 92 and then throwing manual switch 81 to actuate the hydraulic fan motor 50. At this time the driver begins to move across the surface of the area to be cleaned and the pickup head 12 begins picking up all of the dirat and debris from the surface over which it passes. It has been learned from experience that the mobile cleaning apparatus will function well at speeds up to 25 or 30 miles per hour. Due to the fact that the hydraulic pump 80 is driven directly from the mobile vehicle chassis motor, it tends to increase speed as the surface speed of the mobile vehicle chassis increases and thereby increases the air current through the pickup head enabling the machine to function at the increased surface speed. When the collection hopper 40 is full of accumulated dirt and debris, the driver will throw switch 92 in the opposite direction to raise the pickup head 12 to its inoperative position and throw switch 81 in the opposite direction to cut off hydraulic fan motor 50. Upon reaching the trash bin, the driver will throw switch 93 which will actuate the lifting means 65 to raise the collection hopper 40 to its rearwardly raised position above the trash bin. The driver will throw the switch 94 which will actuate hydraulic rams 42 and open the bottom door 15 of the collection hopper 40 and allow the debris to fall into the trash bin. When the collection hopper is empty, he throws switches 94 and 93 in the opposite direction to close the bottom door 41 of the collection hopper 40 and to lower the collection hopper 40 to its lowermost position.

In the drawings and specification, there has been set forth a preferred embodiment of this invention, and although specific terms are employed, they are used in a generic and descriptive sense only and not for purposes of limitation, the invention being defined by the claims.

I claim:

1. A mobile cleaning apparatus for pneumatically removing debris from the surface of parking lots and the like, comprising:

a mobile vehicle chassis;

a pickup head for collecting debris carried by the chassis at a predetermined spaced relationship from the surface to be cleaned and including an air pressure port and a vacuum port therein;

collection hopper means movably mounted on said vehicle chassis and having a positively actuated door in the bottom thereof;

pneumatic pressure conduit means extending from the air pressure port of said pickup head to said collection hopper means;

pneumatic vacuum conduit means extending from the vacuum port of said pickup head to said collection hopper means;

air pump means positioned in said collection hopper means and communicating with said pressure conduit means and said vacuum conduit means, said air pump means creating a partially regenerated air current from said collection hopper means to said pickup head for entraining debris from the surface beneath said pickup head into the air current formed therein and a suction current from said pickup head to said collection hopper means for transporting the entrained debris to said collection hopper means; and means for raising said collection hopper means to a predetermined rearwardly raised position so that said bottom door can be opened and the debris collected within said collection hopper means dumped into a trash bin, said means for raising including a plurality of rigid support legs of substantially equal length, each of said support legs being pivotally connected to one end thereof to said vehicle chassis and at the other end thereof to said collection hopper means, and a hydraulic ram lift means carried by said vehicle chassis and operatively connected to said collection hopper means.

2. A mobile cleaning apparatus as claimed in claim 1 including means carried by said vehicle chassis and operatively connected to said pickup head for vertically adjusting said pickup head to a predetermined distance from the surface to be cleaned.

3. A mobile cleaning apparatus as claimed in claim 1 wherein said pickup head comprises outwardly extending and opposing arms transversely carried by said vehicle chassis, said opposing arms being swept forward in the direction of forward travel of said vehicle chassis, said pickup head further comprising an air pressure port adjacent to the free end of each opposing arm for impinging air onto the surface and a vacuum port in said pickup head at the juncture of said opposing arms for removing dirt and debris from said pickup head.

4. A mobile cleaning apparatus as claimed in claim 3 wherein said pressure conduit means comprises a bifurcated pressure duct, said bifurcated pressure duct having a leg thereof extending to and communicating with the air pressure port of each of said arms of said pickup head.

5. A mobile cleaning apparatus as claimed in claim 3 wherein said vacuum conduit means comprises a suction duct connected to and fluidly communicating with a vacuum port of said pickup head at the juncture of said opposing arms.

6. A mobile cleaning apparatus as claimed in claim 2 wherein said means for vertically adjusting said pickup head comprises a hydraulically actuated bell and crank.

7. A mobile cleaning apparatus as claimed in claim 1 wherein said door of said collection hopper means is actuated by a hydraulic ram.

8. A mobile cleaning apparatus as claimed in claim 1 wherein said rigid support legs are in substantially parallel relationship to each other at all times.

9. A mobile cleaning apparatus as claimed in claim 1 wherein said air pump means includes an inverted conical filter screen having a hydraulically driven fan positioned therewithin so as to pull an air current through said filter screen, said fan communicating with the upstream end of said pressure conduit means and with the downstream end of said vacuum conduit means through said screen.

10. A mobile cleaning apparatus for pneumatically removing debris from the surface of parking lots and the like, comprising:

a mobile vehicle chassis;

a pickup head for collecting debis comprising outwardly extending and opposing arms having an air pressure port adjacent to the free end of each opposing arm for impinging air onto the surface to be cleaned and a vacuum port in said pickup head at the juncture of said opposing arms for removing dirt and debris from said pickup head, said pickup head being transversely carried by said vehicle chassis at a predetermined spaced relationship from the surface to be cleaned and with said opposing arms thereof being swept forwardly in the direction of forward travel of said vehicle chassis;

a hydraulically actuated bell and crank for vertically adjusting said pickup head, said bell and crank being carried by said vehicle chassis and operatively connected to said pickup head for vertically adjusting said pickup head to a predetermined distance from the surface to be cleaned;

collection hopper means movably mounted on said vehicle chassis and having a hydraulically actuated door in the bottom thereof;

a bifurcated pneumatic pressure duct having a leg thereof extending to and communicating with said air pressure port in each opposing arm of said pickup head, said pressure duct extending from said pickup head to said collection hopper means with said legs thereof being joined at the end remote from said pickup head;

a pneumatic vacuum duct connected to and communicating with said vacuum port of said pickup head, said vacuum duct extending from said pickup head to said collection hopper means;

an inverted, conical filter screen having a hydraulically driven fan positioned therewithin disposed in said collection hopper means so as to pull an air current through said filter screen, said fan communicating with the upstream end of said pressure duct and with the downstream end of said vacuum duct through said screen for creating a partially regenerated air current through said pressure duct to said pickup head for entraining debris from the surface beneath said pickup head into the air current formed therein and a suction current through said vacuum duct from said pickup head for transporting the entrained debris to said collection hopper means; and means for raising said collection hopper means to a predetermined rearwardly raised position so that said bottom door may be opened and the debris collected within said collection hopper means dumped into a trash bin, said means for raising said collection hopper means including a pluality of parallel, rigid support legs of substantially equal length, each of said support legs being pivotally connected at one end thereof to said vehicle chassis and at the other end thereof to said collection hopper means, and a hydraulic ram lift means carried by said vehicle chassis and operatively connected to said collection hopper means.

11. A mobile cleaning apparatus as claimed in claim 10 wherein said legs of said biburcated pneumatic pressure duct and said pneumatic vacuum duct are each comprised of two detachably mated, rigid sections which disconnect when said collection hopper means is raised to the rearwardly raised for dumping the debris contained therein and are brought back into a matingly engaged relationship when said collection hopper means is lowered.

12. A mobile cleaning apparatus adapted for pneumatically removing debris from the surface of parking lots and the like comprising a mobile vehicle chassis, pickup means carried by said chassis at a predetermined spaced relationship from the surface to be cleaned, collection hopper means mounted on said chassis for collecting the debris, air pump means carried by said collection hopper means and communicating with said pickup means for creating a turbulent air current within said pickup means and a suction current therefrom to said collection hopper means, and means for dumping the accumulated debris from said collection hopper means, said pickup means comprising;

a pickup head for collecting debris comprising outwardly extending and opposing arms having an air pressure port adjacent to the free end of each opposing arm for impinging air onto the surface to be cleaned and a vaccum port in said pickup head at the juncture of said opposing arms for removing dirt and debris from said pickup head, said pickup head being transversely carried by said vehicle chassis at a predetermined spaced relationship from the surface to be cleaned and with said opposing arms thereof being swept forwardly in the forward direction of travel of said chassis;

a bifurcated pneumatic pressure duct having a leg thereof extending to and communicating with said air pressur port in each opposing arm of said pickup head, said pressure duct extending from said pickup head to said collection hopper means with said legs thereof being joined at the end remote from said pickup head; and a pneumatic vacuum duct connected to and communicating with said vacuum port of said pickup head, said vacuum duct extending from said pickup head to said collection hopper means;

whereby the debris stirred up within said pickup head by said pressure duct is pulled into said vacuum duct and transported to said collection hopper means with debris removal being facilitated by the leading location of said air pressure ports and the trailing and centralized location of said vacuum port duct of said pickup head.

13. A mobile cleaning apparatus as claimed in claim 12 wherein said pickup head includes a downwardly depending flexible member on the leading and trailing edges thereof and a metal skid plate member on each opposing end thereof.

14. A mobile cleaning apparatus as claimed in claim 12 wherein said bifurcated pneumatic pressure duct includesa helical coil positioned within the end portion of each of said legs remote from said collection hopper means for creating a turbulent air current within said pickup head.

15. A mobile cleaning apparatus as claimed in claim 12 including a hydraulically actuated bell and crank carried by said chassis and operatively connected to said pickup head for vertically adjusting said pickup head to a predetermined vertically spaced-apart location from said surface to be cleaned.

16. A mobile cleaning apparatus adapted for driving over parking lots and the like to remove debris from the surface thereof comprising a mobile vehicle chassis, pickup means carried by said chassis at a predetermined spaced relationship from the surface to be cleaned, collection hopper means mounted on said chassis for collecting the debris, air pump means carried by said chassis and communicating with said pickup means for creating a turbulent air current within said pickup means and a suction current therefrom to said collection hopper means, and means for dumping the accumulated debris from said collection hopper means, said means for dumping comprising:

a hydraulically actuated door in the bottom of said collection hopper means;

means for raising said collection hopper means to a predetermined rearwardly raised position, said means for raising said collection hopper means including a plurality of rigid support legs of substantially equal length, each of said support legs being pivotally connected at one end thereof to said vehicle chassis and at the other enc thereof to said collection hopper means, and a hydraulic ram lift means carried by said vehicle chassis and operatively connected to said collection hopper means;

whereby said collection hopper means may be raised upwardly and rearwardly at a predetermined time and said bottom door opened so as to allow the collected debris to fall into a trash bin disposed therebeneath.

17. A mobile cleaning apparatus as claimed in claim 15 wherein said hydraulically actuated door comprises the floor of the back portion of said collection hopper means, said door being pivotally connected to said collection hopper means along the innermost side thereof extending the width of the bottom surface of said collection hopper means and in a direction generally perpendicular to the longitudinal axis of said vehicle chassis, and a pair of hydraulic rams operatively connected thereto, said rams being positioned in spaced-apart relationship on the underside of said collection hopper means and extending parallel to the longitudinal axis of said vehicle chassis with each of said rams connected at one end thereof to said door and at the other end thereof to said collection hopper means for urging said door downwardly when said hydraulic rams are actuated.

18. A mobile cleaning apparatus as claimed in claim 16 wherein said means for raising comprising four rigid support legs to support said collection hopper means, said rigid legs being in substantially parallel relationship one to the other at all times.

19. A mobile cleaning apparatus adapted for pneumatically removing debris from the surface of parking lots and the like comprising a mobile vehicle chassis, a pickup head carried by said chassis at a predetermined spaced relationship from the surface to be cleaned, collection hopper means mounted on said chassis for collecting the debris, air blower means carried by said chassis and including first conduit means communicating with said pickup head for introducing a turbulent air current into said pickup head and second conduit means communicating with said pickup head for creating a suction current from said pickup head to said collection hopper means, and means for dumping the accumulated debris from said collection hopper means, said pickup head comprising:

outwardly extending and opposing forwardly swept arms having an air pressure port adjacent to the free end of each opposing arm communicating with said first conduit means for impinging air onto the surface to be cleaned and a vacuum port in said pickup head at the juncture of said opposing arms communicating with said conduit means for removing dirt and debris from said pickup head;

downwardly depending flexible wall members secured adjacent to the leading and trailing edges of said pickup head; and a metal skid plate member secured to each of the longitudinally opposing ends of sad pickup head.

20. A mobile cleaning apparatus as claimed in claim 19 wherein said first conduit means comprises a duct communicating with each of said spaced-apart air pressure ports located in said pickup head and wherein each of said ducts includes a helical coil positioned within the end portion of said duct adjacent said pickup head and having a twist direction opposite to that of the other coil for creating opposing cyclone air currents in said pickup head when the air current blown through said ducts comes into contact with said helical coils positioned therein.

* * * * *